US010251435B1

(12) United States Patent
Chou

(10) Patent No.: US 10,251,435 B1
(45) Date of Patent: Apr. 9, 2019

(54) DISPOSABLE GLOVE WITH OPEN-CELL INNER LAYER

(71) Applicant: Belle Chou, Union City, CA (US)

(72) Inventor: Belle Chou, Union City, CA (US)

( * ) Notice: Subject to any disclaimer, the term of this patent is extended or adjusted under 35 U.S.C. 154(b) by 139 days.

(21) Appl. No.: 15/437,058

(22) Filed: Feb. 20, 2017

Related U.S. Application Data

(60) Provisional application No. 62/298,934, filed on Feb. 23, 2016.

(51) Int. Cl.
*A41D 19/015* (2006.01)
*A41D 19/00* (2006.01)

(52) U.S. Cl.
CPC ..... *A41D 19/0006* (2013.01); *A41D 19/0003* (2013.01); *A41D 19/0024* (2013.01); *A41D 19/0082* (2013.01); *A41D 2400/52* (2013.01); *A41D 2400/62* (2013.01)

(58) Field of Classification Search
CPC ... B29C 41/14; B29C 71/0009; B29C 33/424; B29C 33/505; B29C 41/40; A41D 19/0058; A41D 2400/34; A41D 2400/52; A41D 19/0055; A41D 2400/32; A41D 19/0003; A41D 19/0006; A41D 19/0068; A41D 2400/60; A41D 19/04; A41D 19/01547; A41D 31/0038; A61B 42/00; A61L 31/16; A61L 2300/606; A61L 31/005; A61F 6/04; A61F 13/15699; A61F 2006/044; A61F 2013/530226; A61F 2013/530649; A61F 2013/53081
See application file for complete search history.

(56) References Cited

U.S. PATENT DOCUMENTS 2,328,769 A * 9/1943 Auzin ..... B29C 41/14 264/DIG. 50
3,797,494 A 3/1974 Zaffaroni
3,978,204 A 8/1976 Charle
5,087,513 A * 2/1992 Kim ..... B01D 71/62 264/109
5,232,769 A 8/1993 Yamato
5,314,653 A * 5/1994 Haralambopoulos ..... A61F 6/04 264/301
5,591,779 A * 1/1997 Bleys ..... C08G 18/10 521/109.1
5,695,779 A 12/1997 Mori
(Continued)

*Primary Examiner* — Robert H Muromoto, Jr.
(74) *Attorney, Agent, or Firm* — Quickpatents, LLC; Kevin Prince

(57) ABSTRACT

A disposable glove includes an elastomeric base layer having an inside surface and an outside surface. An elastomeric inner layer is fixed with the inside surface of the base layer and comprises an open-cell foam material configured to absorb excessive moisture on the hand. Preferably the inner layer is between one and eight mils thick, allowing enough flexibility that the glove may take an ambidextrous form. The inner layer is a closed-cell foam material treated with a chemical agent to open a plurality of the closed cells in situ. A liquid-impervious layer situated between the base layer and the inner layer, and an open-cell absorbent outer layer, may also be included. The inner layer includes a plurality of encapsulated compound microcapsules and a plurality of cotton fibers. Methods of manufacturing the glove are included.

6 Claims, 3 Drawing Sheets

(56) References Cited

U.S. PATENT DOCUMENTS 6,953,582 B2 * 10/2005 Chou ..... A41D 19/0058 424/400
7,276,036 B2 * 10/2007 Sendijarevic ..... A61F 5/01 602/6
7,514,121 B2 * 4/2009 Williams ..... A41D 19/0003 427/288
8,499,363 B2 * 8/2013 Chou ..... A41D 19/0058 2/159
8,752,215 B2 * 6/2014 Chou ..... A41D 19/0058 2/169
D816,291 S * 5/2018 Chou ..... D2/617
9,993,416 B1 * 6/2018 Chou ..... A61K 8/73
2001/0048937 A1 * 12/2001 Chou ..... A61B 42/60 424/443
2003/0004449 A1 1/2003 Lafratta
2003/0017193 A1 * 1/2003 Chou ..... A41D 19/0058 424/443
2003/0204893 A1 * 11/2003 Chou ..... A61L 31/16 2/161.6
2004/0062792 A1 * 4/2004 Chou ..... A41D 19/0058 424/443
2004/0163973 A1 * 8/2004 Longo ..... B32B 27/08 206/204
2004/0231065 A1 * 11/2004 Daniel ..... A61L 15/60 8/405
2005/0112180 A1 * 5/2005 Chou ..... A41D 19/0058 424/443
2006/0029790 A1 * 2/2006 Sendijarevic ..... A61F 5/01 428/306.6
2006/0062991 A1 * 3/2006 Sendijarevic ..... A61F 5/01 428/318.4
2007/0012397 A1 * 1/2007 de Jong ..... A41D 31/0038 156/252
2007/0039083 A1 * 2/2007 Williams ..... A41D 19/0003 2/16
2008/0016601 A1 * 1/2008 McCrorey ..... A41D 19/0006 2/159
2008/0034467 A1 * 2/2008 Chou ..... A41D 19/0058 2/159
2008/0196143 A1 * 8/2008 Chou ..... A41D 19/0058 2/161.7
2008/0205828 A1 * 8/2008 Cook ..... G02B 6/4404 385/100
2013/0052248 A1 2/2013 Yuen
2013/0064876 A1 3/2013 Viladot
2013/0283499 A1 * 10/2013 Chou ..... A41D 19/0058 2/169
2015/0164160 A1 * 6/2015 Furlong ..... A41D 19/0003 2/169
2015/0257464 A1 * 9/2015 Furlong ..... A41D 19/0003 2/161.8
2015/0320586 A1 * 11/2015 Nguyen ..... A61F 6/04 128/844
2016/0193091 A1 * 7/2016 Hegde ..... A61F 13/534 604/369

* cited by examiner

DISPOSABLE GLOVE WITH OPEN-CELL INNER LAYER

CROSS-REFERENCE TO RELATED APPLICATIONS

This application claims the benefit of U.S. Provisional Patent Application 62/298,934, filed on Feb. 23, 2016, and incorporated herein by reference.

STATEMENT REGARDING FEDERALLY SPONSORED RESEARCH AND DEVELOPMENT

Not Applicable.

FIELD OF THE INVENTION

This invention relates to gloves, and more particularly to absorbent disposable gloves.

DISCUSSION OF RELATED ART

Re-usable gloves having an inner moisture-absorbent layer for contacting a user's hand are known in the art. Several types of such gloves are available having an inner layer of open-cell foam material, such open-cell foam material being particularly effective at absorbing sweat and moisture from the user's skin. However, prior art gloves of this type have a relatively thick inner layer, necessitating that the forms be either left or right-handed due to the inflexibility of such thick materials. Further, such open-cell foam layers are typically created through expensive mechanical cell-opening processes, resulting in relatively high manufacturing costs.

Therefore, there is a need for a disposable glove having an open-cell inner layer that is also relatively thin, allowing for ambidextrous use, the inner layer being formed through chemically treating an inexpensive closed-cell foam material. Such a needed invention would further optionally provide a liquid-impervious intermediate layer, a moisture-absorbing open-cell inner layer enhancing the barrier properties provided by the outer layer by delaying the swelling of the outer layer by blocking liquids from contacting the outer layer. The present invention accomplishes these objectives.

SUMMARY OF THE INVENTION

The present device is a glove for a hand of a person. The glove includes an elastomeric base layer having an inside surface and an outside surface. An elastomeric inner layer is fixed with the inside surface of the base layer and comprises an open-cell foam material configured to absorb excessive moisture on the hand. Preferably the inner layer is between one and eight mils thick, allowing enough flexibility that the glove may take a general, ambidextrous form of the hand and be used with either left or right hands.

Preferably the inner layer is a closed-cell foam material treated with a chemical agent to open a plurality of the closed cells to convert the closed-cell foam material into the open-cell foam material. The inner layer may cover substantially the entire inside surface of the base layer, or the base layer except for distal ends of digit portions of the glove.

The glove may further include a liquid-impervious layer situated between the base layer and the inner layer. In another embodiment, the glove further includes an open-cell outer layer.

In one embodiment, the inner layer includes a plurality of microcapsules, each having a shell surrounding an encapsulated compound, such as water, aloe vera, vitamins, fragrance, or the like, mixed therethrough. In one embodiment, the inner layer may further include a plurality of cotton fibers to absorb additional moisture on the hand.

The present invention is a disposable glove having an open-cell inner layer that is also relatively thin, allowing for ambidextrous use, the inner layer being formed through chemically treating an inexpensive closed-cell foam material. The present glove further optionally provides a liquid-impervious intermediate layer, an option for providing compound-filled microcapsules and/or cotton fibers within the inner layer, and a moisture-absorbing open-cell outer layer. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
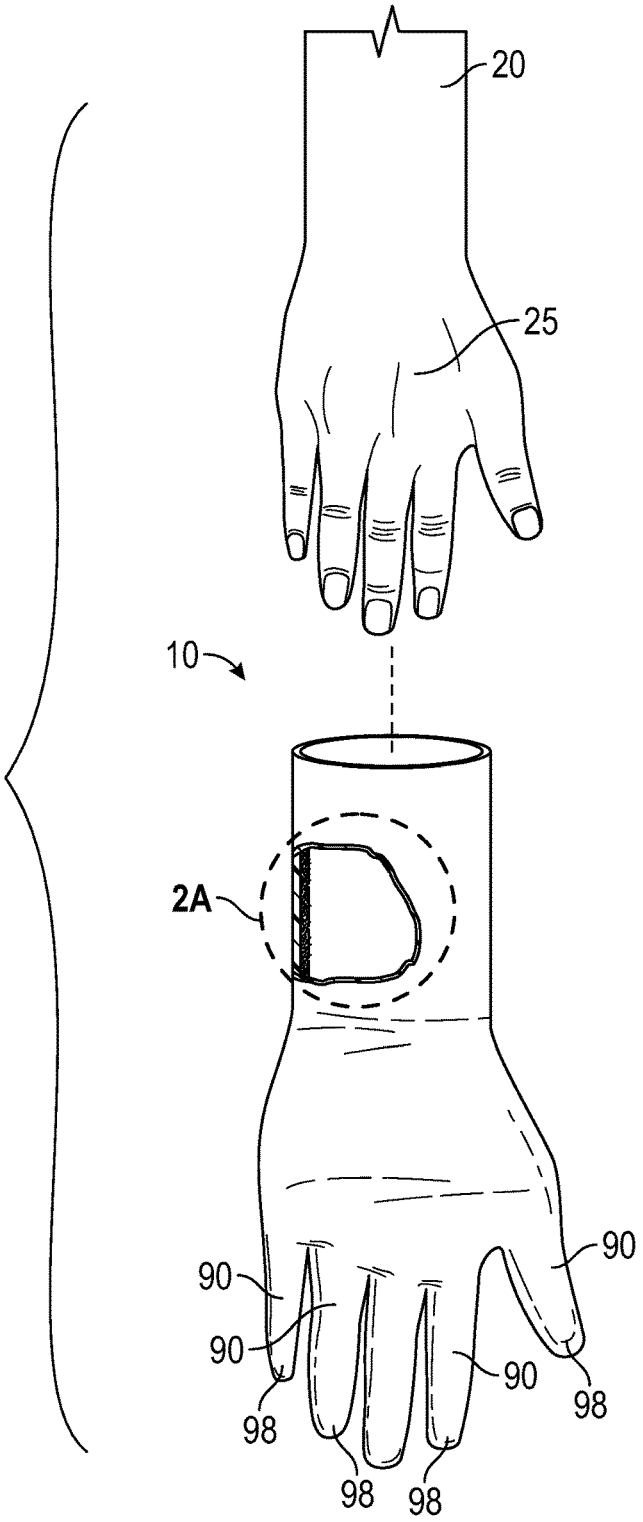
FIG. 1 is an exploded perspective view of the invention, illustrating a glove of the invention as about to be fitted onto a person's hand, the glove partially cut away.
Figure 2A:
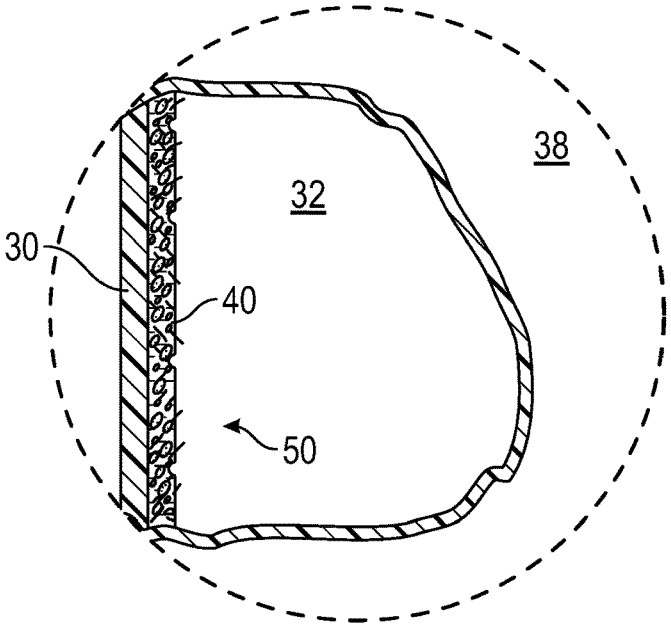
FIG. 2A is a partial perspective view of the cutaway portion of a first embodiment of the glove, taken along line 2-2 of FIG. 1.

FIGS. 1 and 2A illustrate a glove 10 for a hand 25 of a person 20. The glove 10 includes an elastomeric base layer 30 having an inside surface 32 and an outside surface 38. The elastomeric base layer preferably includes an elastomeric material taken from the group consisting of Nitrile, Natural Rubber Latex, Polychloroprene, Polyurethane, polyisoprene, PVA, acrylic, butyl silicone rubber, fluoro-elastomer, PVC, or the like.

An elastomeric inner layer 40 is fixed with the inside surface 32 of the base layer 30. The inner layer 40 comprises an open-cell foam material 50 configured to absorb excessive moisture on the hand 25. Preferably the inner layer 40 is between one and eight mils thick, allowing enough flexibility that the glove 10 may take a general, ambidextrous form of the hand 25 and be used with either left or right hands 25.

Preferably the inner layer 40 is a closed-cell foam material 60 treated with a chemical agent 70 to open a plurality of the closed cells to convert the closed-cell foam material 60 into the open-cell foam material 50, preferably having a foam density of between 25% and 75%. Such a chemical agent 70 may be, for example, a super-absorbent polymer (SAP) or anti-foam agent.

The inner layer 40 may cover substantially the entire inside surface 32 of the base layer 30, or the base layer 30 except for distal ends 98 of digit portions 90 of the glove (FIG. 1).

Figure 2B:
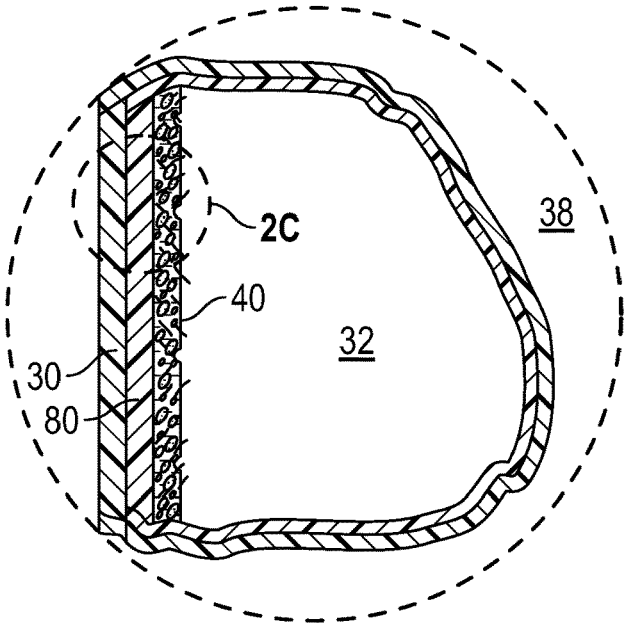
FIG. 2B is a partial perspective view of the cutaway portion of a second embodiment of the glove, taken along line 2-2 of FIG. 1.
Figure 2C:
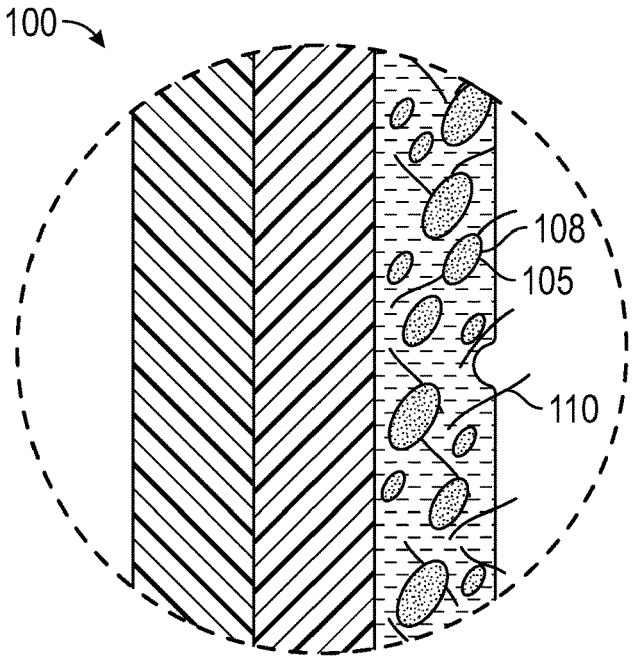
FIG. 2C is a partial perspective view of the cutaway portion of a third embodiment of the glove, taken along line 2C-2C of FIG. 2B.
Figure 2D:
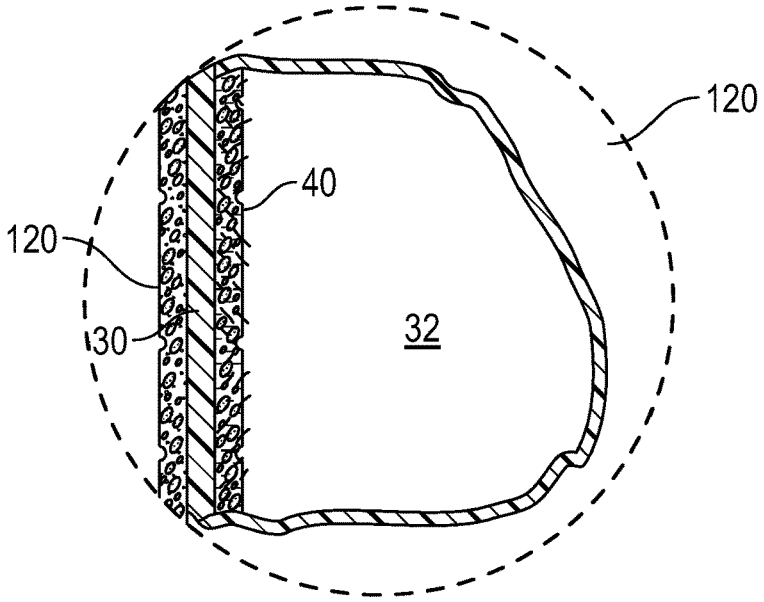
FIG. 2D is a partial perspective view of the cutaway portion of a fourth embodiment of the glove, taken along line 2-2 of FIG. 1.

The glove 10 may further include a hydrophobic, liquid-impervious layer 80 (FIG. 2B) situated between the base layer 30 and the inner layer 40. Such a liquid-impervious layer 80 may be formed from a relatively thin liquid-impervious material such as a fluoropolymer-based water repellent. In another embodiment, the glove 10 further includes an open-cell outer layer 120 (FIG. 2D). Such an open-cell outer layer 120 may be formed from a material such as nitrile, natural rubber latex, polychloroprene, polyurethane (for gripping), polyisoprene, or the like.

In one embodiment, the inner layer 40 includes a plurality of microcapsules 100 (FIG. 2C), each having a shell 108 surrounding an encapsulated therapeutic compound 105 mixed therethrough. Such a compound 105 is preferably taken from the group consisting of: water, aloe vera, vitamins, fragrance, protectant against chemicals; pH balancing buffer, moisturizer, caffeine, NSAIDs, nicotine, antiperspirant, antibacterial compounds, and sun-blocking compounds. In one embodiment, the inner layer 40 may further include a plurality of cotton fibers 110 to absorb additional moisture on the hand.

A method of making the glove 10 includes the steps of providing, preferably, an ambidextrous hand form. In the embodiment including the open-cell outer layer 120, the outer layer 120 is applied to the hand form first. Then the outer layer 120 or hand form is coated with the elastomeric base layer 30.

In the embodiment having the liquid-impervious layer 80, this layer 80 is applied next to the base layer 30. Otherwise, the base layer 30 is coated with the inner layer of closed-cell foam material 60, which may also optionally include the microcapsules 100 and/or cotton fibers 110. The chemical agent 70 is applied next to open a plurality of the foam cells to form the open-cell inner layer 40.

The inner layer 40 may cover substantially all of the inside surface 32 of the base layer 30, or the base layer 30 except for the distal ends 98 of the digit portions 90 of the glove 10.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A method of making a glove for a person's hand, comprising the steps:

a) providing an ambidextrous hand form;

c) coating the hand form with an elastomeric base layer;

e) coating the elastomeric base layer with an inner layer comprising a closed-cell foam;

f) chemically treating the closed-cell foam inner layer with a chemical agent to open a plurality of the closed cells; and g) inverting the glove while removing the glove from the hand form.

2. The method of claim 1 further including the step:

d) coating the hand form with a liquid-impervious layer.

3. The method of claim 1 further including the step:

b) coating the hand form with an open-cell foam outer layer configured to absorb moisture.

4. The method of claim 1 wherein step e) is replaced with:

e) coating the elastomeric base layer with an inner layer comprising a closed-cell foam except for the distal ends of finger portions and a thumb portion of the glove.

5. The method of claim 1 wherein step e) is replaced with:

e) coating the elastomeric base layer with an inner layer comprising a closed-cell foam that includes a plurality of microcapsules having a shell surrounding an encapsulated compound mixed therethrough.

6. The method of claim 5 wherein step e) is replaced with:

e) coating the elastomeric base layer with an inner layer comprising a closed-cell foam and a plurality of cotton fibers.

* * * * *